US007779643B2

(12) United States Patent
Simons

(10) Patent No.: US 7,779,643 B2
(45) Date of Patent: Aug. 24, 2010

(54) REFRIGERATION CYCLE DEHUMIDIFIER

(76) Inventor: Everett Simons, 10 South Park Ln., Mansfield, MA (US) 02048

( * ) Notice: Subject to any disclaimer, the term of this patent is extended or adjusted under 35 U.S.C. 154(b) by 984 days.

(21) Appl. No.: 11/180,210

(22) Filed: Jul. 13, 2005

(65) Prior Publication Data

US 2007/0012060 A1 Jan. 18, 2007

(51) Int. Cl.
*F25D 21/00* (2006.01)

(52) U.S. Cl. ..... 62/272; 62/188; 62/285

(58) Field of Classification Search ..... 62/89, 62/93, 404, 285, 188, 272
See application file for complete search history.

(56) References Cited

U.S. PATENT DOCUMENTS

| | | | | |
|---|---|---|---|---|
| 2,438,120 | A | 3/1946 | Freygang | |
| 2,752,759 | A * | 7/1956 | Sperzel | 62/159 |
| 2,755,072 | A * | 7/1956 | Kreuttner | 165/59 |
| 2,975,609 | A | 3/1961 | Allander | |
| 4,176,525 | A | 12/1979 | Dougan et al. | |
| 5,901,565 | A | 5/1999 | Morton | |
| 6,318,118 | B2 | 11/2001 | Hanson | |
| 6,490,876 | B2 | 12/2002 | Derryberry | |
| 6,715,307 | B2 * | 4/2004 | Hatakeyama et al. | 62/244 |
| 6,751,970 | B2 * | 6/2004 | Wightman | 62/196.4 |
| 6,796,135 | B1 * | 9/2004 | Wang et al. | 62/150 |
| 2002/0174665 | A1 * | 11/2002 | Pritchard et al. | 62/93 |
| 2004/0168451 | A1 * | 9/2004 | Bagley | 62/196.4 |

FOREIGN PATENT DOCUMENTS

| | | | |
|---|---|---|---|
| DE | 21 49 548 | A1 | 4/1972 |
| DE | 24 13 618 | A1 | 9/1975 |
| DE | 87 07 953 | | 7/1988 |
| DE | 197 31 369 | C1 | 7/1998 |
| EP | 0 231 789 | A2 | 8/1987 |
| JP | 55-107852 | A | 8/1980 |
| JP | 61-093332 | A | 5/1986 |
| JP | 08-145414 | A | 6/1996 |
| JP | 09-089297 | A | 4/1997 |
| JP | 10-238810 | A | 9/1998 |
| JP | 2001-065917 | A | 3/2001 |
| JP | 2001-182965 | A | 7/2001 |
| JP | 2002-188827 | A | 7/2002 |
| JP | 2002-267204 | A | 9/2002 |

* cited by examiner

*Primary Examiner*—Melvin Jones

(57) ABSTRACT

Methods and apparatus that improve the effectiveness of a compression-based refrigeration cycle dehumidifier by allocating thermally distinct sections of the condenser to different air flows are disclosed. A bypass opening and divider plate direct ambient air to the refrigerant inlet section of the condenser. Air that has been cooled and dehumidified by the evaporator is directed to the rest of the condenser, with the air from the refrigerant outlet section of the evaporator being preferentially directed downstream, in the refrigerant flow path sense, from that section of the condenser already allocated to the ambient air coming from the bypass opening. The flows of ambient air and dehumidified air can be adjusted to improve moisture removal rates and avoid blockage of the evaporator by freezing of the condensate onto the evaporator. The system may also be used to remove condensates other than water.

26 Claims, 6 Drawing Sheets

REFRIGERATION CYCLE DEHUMIDIFIER

BACKGROUND OF THE INVENTION

1. Field of the Invention

The invention relates to dehumidification systems using a compression-based refrigeration cycle.

2. Description of Related Art

The basic components of a compression-based refrigeration cycle are a compressor, a condenser, an expansion valve, an evaporator, and a refrigerant (a volatile liquid). Compression-based refrigeration cycles work because of a combination of physical laws common to all liquids. First, the temperature at which a liquid boils decreases as the ambient pressure decreases. Second, it takes heat to boil (vaporize) a liquid. A liquid vaporizing because of a reduction in ambient pressure absorbs heat from its surroundings; if the vapor is subsequently compressed enough to condense back to a liquid, it gives off heat as it condenses.

A compressor, the active element in the cycle, forces refrigerant to circulate. A compressor pulls cool, low-pressure refrigerant vapor out of the evaporator and compresses it, raising both the pressure and temperature of the refrigerant vapor. This hot compressed refrigerant vapor then flows into a condenser.

A condenser, the high pressure side of the cycle, contains both hot vapor and liquid refrigerant. Because of its high pressure, the vapor refrigerant condenses at a high temperature, expelling heat to the air around the condenser. This resulting warm, pressurized liquid refrigerant then flows to and through an expansion valve.

An expansion valve is a flow restriction which allows the evaporator to be at a lower pressure than the condenser. As warm, high-pressure liquid refrigerant from the condenser flows through the expansion valve towards the evaporator, the pressure drops. Some of the refrigerant boils, cooling the resulting mixture of liquid and vapor refrigerant as it flows to an evaporator.

An evaporator, the low pressure side of the cycle, contains both cold liquid and vapor refrigerant. Because of its low pressure, the liquid refrigerant evaporates (boils) at a low temperature, absorbing heat from the air around the evaporator. The cool vapor is pulled out of the evaporator by the compressor (keeping the evaporator pressure low), thus completing the cycle.

A compression-based refrigerant cycle dehumidifier dries the air because the evaporator is colder than the dew point of the air around it: some of the moisture in the air condenses out onto the evaporator. The resulting liquid water being removed is called "condensate" and typically drips down to be caught in a tray or basin. The air, now cooler and dryer, flows to and cools the condenser. Some of the air leaving the dehumidifier typically passes over and cools the fan motor and the compressor motor.

A dehumidifier's electrical system typically includes a humidity sensor, a set-point adjuster, a compressor motor, and a fan motor. The electrical system often includes one or more of the following: an "off" switch built into the high end of the set point adjuster, a temperature sensor to shut off the dehumidifier (or at least the compressor) if potential icing conditions are detected, and (in units without a drain line) a condensate-level float switch or catch basin weight sensor to shut off the dehumidifier if the catch basin fills up with condensate.

Air about to enter the evaporator is typically drawn through a filter first, to prevent fibers and particles from being trapped by the wet surfaces and clogging the evaporator.

U.S. Pat. No. 2,130,092 discloses a dehumidifier virtually indistinguishable from modern units except for the control electronics and the refrigerant composition. The dehumidifier comprises a refrigerant loop, an air flow path, and an electrical system. The refrigerant loop is a compression-based refrigeration cycle, as previously described. The air passes across the chilled evaporator, cooling the air: the drop in air temperature causes some of the moisture in the air to condense out on the evaporator; this condensate drips down onto a catch pan. The cooled, dehumidified air is then pulled across the hot condenser, dissipating the heat from the compressed refrigerant. The details mentioned include a "finned evaporator" and an "air-cooled fin-type condenser" shown with its refrigerant inlet section adjacent and thermally coupled to its refrigerant outlet section.

U.S. Pat. No. 5,901,565 claims a fan within an orifice plate between the evaporator and the condenser; the fan and orifice plate inhibit radiant heat transfer from the condenser to the evaporator. In addition, it discloses a bypass opening downstream of the evaporator and upstream of the fan and fan motor. The bypass inlet allows some room air to enter the dehumidifier immediately after the evaporator, where it mixes with the cold dehumidified air. The mixture of dehumidified air and bypass air then goes through and cools the condenser. Entraining the bypass air dilutes and thus lowers the temperature of the air being discharged, reducing the perception of heat coming from the dehumidifier.

Household dehumidifiers typically operate using a simple on/off control: when the humidity rises above a set point, the system turns on; when the humidity drops sufficiently below the set point, it turns off. This set point is typically adjustable by the user. Other than a full catch basin (in units without a drain line), the most common reason for a dehumidifier to stop working is because of frost or ice build-up on the evaporator.

U.S. Pat. No. 2,438,120 discloses the use of a thermostat to detect when the evaporator is approaching conditions where frost might accumulate, e.g. when the air passing through the top of the evaporator drops below 1.7° C. (35° F.), and turn off the compressor until the thermostat warms up. It shows the fan and its motor just upstream of the condenser, and has an adjustable air restriction in the form of a main shutter with rotating slats immediately after the evaporator. In addition, it discloses a bypass opening downstream of the main shutter and upstream of the fan and fan motor; the bypass opening has its own adjustable restriction in the form of a bypass shutter. Opening the bypass shutter allows some room air to enter the dehumidifier immediately after the main shutter, where it mixes with the cold dehumidified air and is pulled through the fan; the mixture of dehumidified air and bypass air then goes through the condenser and cools it.

U.S. Pat. No. 6,490,876 describes various situations where a control system detects impending or actual freezing of condensate onto the evaporator, and shuts down the compressor motor either for a predetermined interval or until freezing conditions are abated, while allowing the fan to continue running. This allows the dehumidifier to defrost, and then continue dehumidifying. Disclosed situations indicating condensate freezing include the temperature of the evaporator dropping well below freezing, dropping rapidly when just below freezing, or when the current drawn by the compressor motor drops below a particular threshold or drops rapidly from its typical operating point.

BRIEF SUMMARY OF THE INVENTION

An object of the present invention is to increase the effectiveness of apparatus that use the cold side of a compression-based refrigeration cycle (the evaporator) to draw condensate out of the air. The "effectiveness" is defined herein as the amount of condensation per unit time. It is a further object of the present invention to extend the range of conditions over which the apparatus can operate without being impeded by freezing of condensate onto the evaporator. Intermixing air streams of different temperatures without extracting energy from the process forever forfeits that energy; maintaining separation between the bypass air and the main air flow and reducing superheating of the refrigerant vapor improves the effectiveness of the system.

In one embodiment, improvement is achieved by directing the main flow of air through the evaporator and then through the middle and refrigerant outlet section of the condenser, while a bypass opening allows a bypass flow of air to be pulled in to cool the refrigerant inlet section of the condenser without first passing through the evaporator. The main air and the bypass air can be prevented from substantially intermixing prior to reaching the condenser. The air passing through the refrigerant outlet section of the evaporator can be directed to that part of the condenser through which refrigerant flows immediately after the refrigerant flows through that part of the condenser being cooled by the bypass air.

The terms "inlet section" and "outlet section" of a heat exchanger (condenser or evaporator) are meant in a refrigerant-flow sense, rather than an air-flow direction sense. The refrigerant inlet section or simply the "inlet section" of a heat exchanger refers to the first section along the refrigerant flow path of that heat exchanger designed to enable substantial convective heat transfer, e.g., the first finned segment of the coil through which the refrigerant flows within the heat exchanger. The refrigerant outlet section or simply the "outlet section" of a heat exchanger refers to the last section along the refrigerant flow path designed to enable substantial convective heat transfer, e.g., the last finned segment of the coil through which the refrigerant can flow within the heat exchanger. The "medial section" of a heat exchanger refers to the section after (in the refrigerant flow path sense) the inlet section and before (in the refrigerant flow-path sense) the outlet section. Even if a heat exchanger is formed by interconnecting a set of finned segments, neither the inlet section nor the outlet section of the heat exchanger necessarily has to span in integral number of these segments.

In certain embodiments, different sections of a heat exchanger along the refrigerant flow-path are thermally distinct; i.e., transfer heat to or from specific cross-sections of air flow; it can be more convenient if these cross-sections are compact. It can also be beneficial to minimize thermal conduction between different points along the refrigerant flow path of the heat exchanger, particularly between points that are not adjacent in the refrigerant flow-path sense.

An idealized example of a heat exchanger with every section thermally distinct would be a straight, low thermal conductivity tube (e.g. austenitic stainless steel), with high thermal conductivity fins (e.g. aluminum) perpendicular to the tube. In practice, copper tubing is often used because it is relatively easy to work with and any joints can be sealed reliably; spatial constraints usually require such a tube to be a serpentine coil, with substantially straight segments connected by alternating semicircular bends. Such a coil can still be considered to have thermally distinct sections, since each of these sections has a specific cross-section of air flowing through it. It can also be thermodynamically preferable, although not always mechanically practical, for the heat fins not to span more than one of these segments. The thermal conductivity of connections between non-adjacent sections of such a coil can be minimized, e.g. by using lower thermal conductivity material(s) for any required mechanical connections between non-adjacent sections.

In one embodiment of the present invention, a baffle directs the bypass air flow to the refrigerant inlet section of the condenser. The choice of baffle, such as a curved or flat plate, louvers, a diffuser, or a sheet with multiple small openings, depends upon the geometry of the other elements in the particular application, and whether the baffle is meant to be adjustable. The refrigerant outlet section of the evaporator can be adjacent the baffle, so that the refrigerant passing through the condenser is first cooled by air flowing through the bypass opening, then by air from the evaporator refrigerant outlet section, and finally by air from the rest of the evaporator, before flowing out of the condenser towards the expansion valve.

Since these improvements allow the dehumidifier to more effectively cool and thus dehumidify the incoming air flow, the lower temperature of the evaporator becomes more likely to freeze the condensate. In situations that would otherwise cause the dehumidifier to freeze up, modifying the air flow through the system allows the cooling of the evaporator to be throttled back. This can be done several ways, such as by changing the rate of air flow through one or more pathways, by changing the fraction of heat exchanger through which one or more pathways flow, or by a combination. Various mechanisms for modifying the air flow to extend the range of operating conditions are disclosed.

Advantages of the present invention can be used in various ways, such as to increase the effectiveness of an existing system without other alteration, to downsize a given system while retaining the original effectiveness, or to regain some of the performance lost when an environmentally-questionable refrigerant is replaced by one that is safer but less thermodynamically efficient.

BRIEF DESCRIPTION OF THE SEVERAL VIEWS OF THE DRAWINGS

Those skilled in the art will understand that the drawings, described below, are for illustration purposes only. The drawings are not intended to limit the scope of the present teachings in any way. Unless otherwise indicated, all numbers expressing dimensions, measurements, ranges, and so forth used in the specification and claims are to be understood as being modified in all instances by the term "about".

Figure 1A:
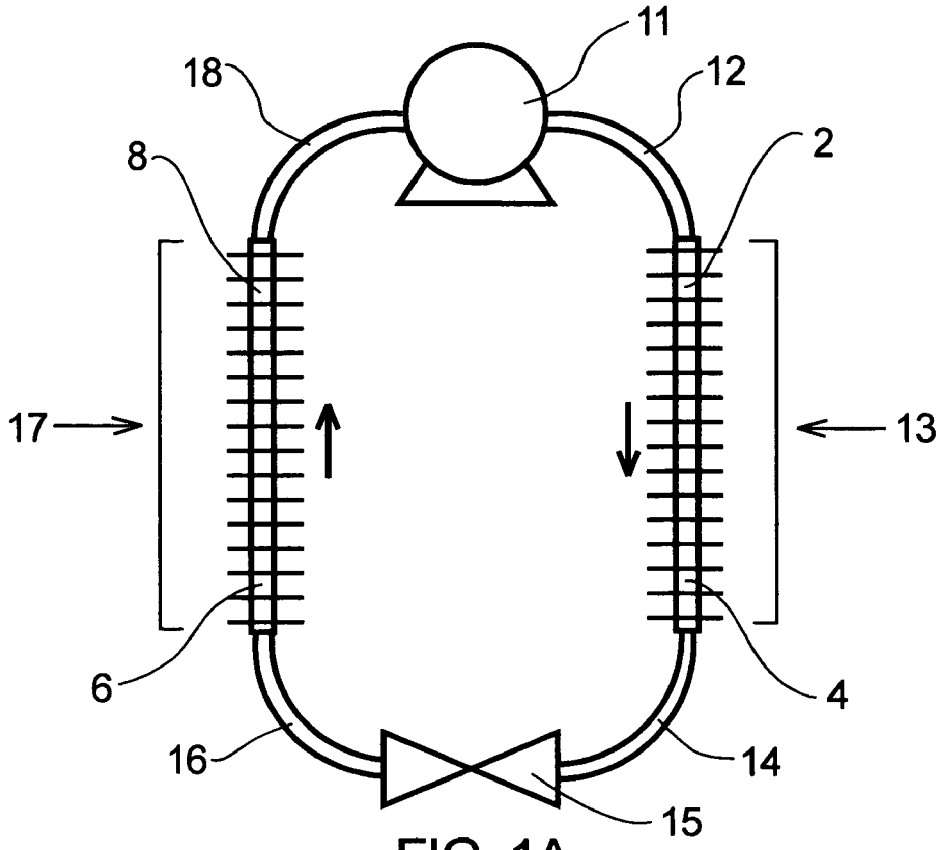
FIG. 1A is a schematic of the refrigerant flow path of a compression-based refrigeration cycle.

These and other features of the present disclosure are set forth herein. In this disclosure the use of the singular includes the possibility of the plural; for example, in the phrase "the fan pulling air through the system" the term "fan" would not preclude the function of pulling air from being carried out by two or more fans, in parallel or in series. The use of "or" means "and/or" unless stated otherwise. The use of the term "with" is not limiting; similarly, the use of the terms "including" and "having", as well as other forms of these terms such as "has", are not limiting. The sectional headings used herein are for organizational purposes only, and are not to be construed as limiting the subject matter described.

Terms such as "top", "bottom", "left", and "right" typically refer to the orientation of features within the drawing, and do not necessarily imply any preferred orientation of the embodiment itself. Some descriptions in this disclosure use a dehumidifier as a representative vehicle for certain embodiments, to present the teachings from the familiar context in which they were developed. This should not be construed as limiting the teachings to applications where the condensate is water. As used herein, unless otherwise stated, the term "liquid" means the liquid phase of the refrigerant; anything condensing out onto the evaporator shall be referred to as "condensate," e.g. water being removed by a dehumidifier, or solvent being recovered from an exhaust flow. The term "vapor" means the gas phase of the refrigerant; the terms "moisture" and "humidity" refer to the gas phase of what ever is being condensed out; the mixture of gases from which condensate is being removed shall be referred to as "air" even if it is e.g. an exhaust flow. The term "freezing" means the solidification of condensate onto the evaporator due to excessively low temperature, independent of the form of the result, e.g. frost vs. clear ice. The term "expansion valve" means an element causing a pressure drop as refrigerant flows through it from the condenser to the evaporator, regardless of whether this element is in the form of, e.g., a valve, a fixed orifice, a capillary tube, an expansion turbine, a vortex chamber, a pressure regulator, etc. The term "through" when used in the sense "air flowing through the evaporator" or "air flowing through the condenser" refers to air coming into thermal contact with the evaporator or condenser, respectively, and then continuing, even if the particular geometry is such that the air is flowing across a heat exchange surface rather than into one side of a heat exchanger and out the other side of the heat exchanger.

DETAILED DESCRIPTION OF THE INVENTION

FIG. 1A is a schematic of a compression-based refrigeration cycle. A compressor 11 draws in cool, low-pressure refrigerant vapor from a tube 18 and mechanically compresses this refrigerant vapor. Adiabatic heating causes the temperature of the refrigerant vapor to rise as it is compressed. The refrigerant exits the compressor as a hot, high-pressure vapor, and flows through a tube 12 to a condenser 13.

Once in condenser 13, the refrigerant first flows through a condenser inlet section 2, the first section of condenser 13. As the refrigerant flows through condenser 13, the pressurized refrigerant vapor cools, and then condenses at an essentially constant temperature. The refrigerant can become entirely liquid and cool further within condenser 13. The refrigerant flows through a condenser outlet section 4, the last section of condenser 13, from which it exits through a tube 14 as a warm, pressurized liquid, possibly still containing some vapor phase.

This warm, high-pressure liquid refrigerant then passes through an expansion valve 15, which is a restriction that causes the pressure of the refrigerant to drop as it flows through. As the pressure drops, some of the liquid refrigerant vaporizes, cooling the refrigerant below the condensation point. The refrigerant leaves the expansion valve through a tube 16 as a cold, low-pressure mixture of liquid and vapor.

This mixture then enters an evaporator 17; once in evaporator 17, the refrigerant first flows through an evaporator inlet section 6, the first section of evaporator 17. As the cold, low-pressure mixture of liquid and vapor refrigerant flows through evaporator 17, heat from the surrounding air flows into the cold evaporator, vaporizing liquid refrigerant at an essentially constant temperature. The cold low-pressure refrigerant vapor may warm slightly towards the end of evaporator 17. The refrigerant flows through an evaporator outlet section 8, the last section of evaporator 17, and leaves as a cool low-pressure vapor through tube 18, to be drawn back into compressor 11, thus completing the refrigerant cycle.

Figure 1B:
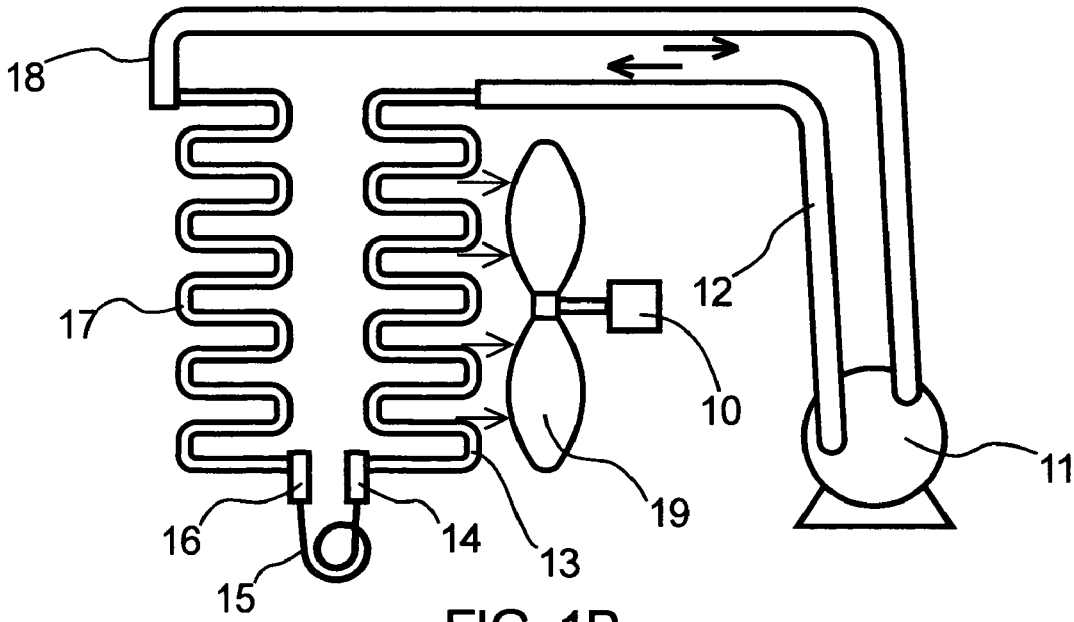
FIG. 1B shows a diagram of a dehumidifier that uses a compression-based refrigeration cycle to condense moisture out of an airflow.

FIG. 1B shows a diagram of a dehumidifier that uses a compression-based refrigeration cycle to condense moisture out of an airflow. A fan motor 10 drives a fan 19 to pull air through the dehumidifier. Air flows across and is cooled by evaporator 17; some moisture condenses out of the air onto the cold surface of evaporator 17. The air is then pulled across and absorbs heat from condenser 13. The air is drawn through fan 19, and cools fan motor 10 and compressor 11 as it exits.

In certain embodiments, tube 12 and tube 18 can include at least one bend. Bends can provide flexibility to facilitate isolation of vibrations coming from compressor 11. Tube 12 and tube 18 should have sufficiently large internal passages to minimize any pressure drops along their lengths, since these pressure drops tend to decrease the efficiency of the system. In certain embodiments, expansion valve 15 can be a narrow tube that connects directly from condenser 13 to evaporator 17, thus eliminating the need for tube 14 or tube 16.

This particular embodiment can drain the liquid refrigerant out of the condenser from the bottom, to reduce or eliminate the release of uncondensed vapor from the condenser, and can pull the cool refrigerant vapor off the evaporator from the top, to reduce or eliminate the release of unvaporized liquid refrigerant from the evaporator. For clarity the subsequent figures omit tube 12, tube 14, tube 16, and tube 18.

Alternately, heat can be drawn out of the refrigerant before or as the pressure drops as the refrigerant flows through expansion valve 15. In one embodiment, the refrigerant leaving condenser outlet section 4 can be cooled before entering the expansion valve by thermally coupling tube 14 and tube 16, so that these tubes together act as a counter-flow heat exchanger. In another embodiment, expansion valve 15 is itself a narrow tube thermally coupled to a section of evaporator 17.

Figure 2A:
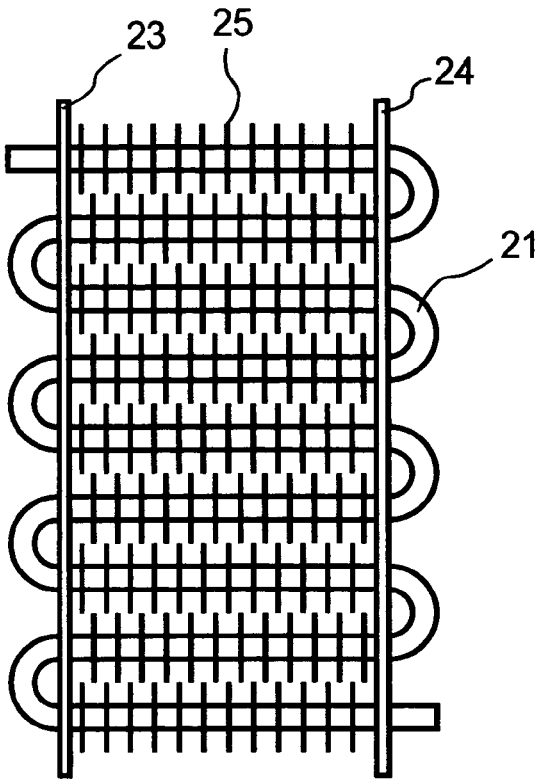
FIG. 2A and FIG. 2B show views of a heat exchanger suitable as a condenser or evaporator in the present invention.
Figure 2B:
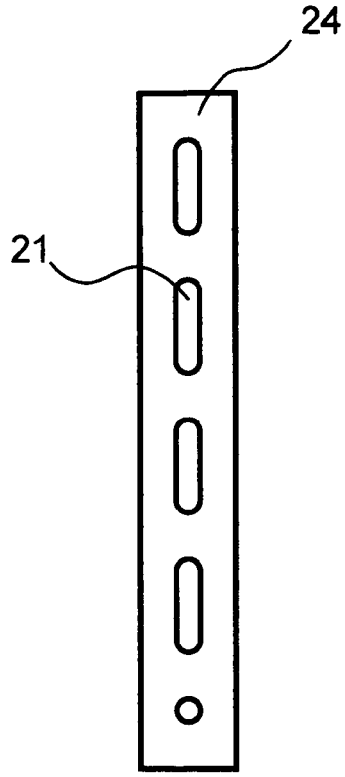

FIGS. 2A and 2B show an embodiment of a heat exchanger configuration. FIG. 2A shows a front view of a heat exchanger with thermally distinct sections, appropriate for use as condenser 13 or as evaporator 17 in FIG. 1. A coil 21 contains a flow of refrigerant. Coil 21 has substantially straight segments, each with multiple fins 25 to increase heat transfer between coil 21 and the air around it. Fins 25 are shown in this embodiment as independent of each other and not bridging different segments of coil 21. In other embodiments, fins can be formed as several strips, each strip spanning a segment multiple times; multiple parallel strips spanning some or all of the segments can also be used. Although not shown, coil 21 may have one or more joints along its length, and may be formed by connecting straight finned tube segments with alternating 180 degree bends.

A left brace 23 and a right brace 24 can provide mechanical support for coil 21. FIG. 2B shows a side view of the heat exchanger, looking towards right brace 24. These braces can include points for mechanically attaching coil 21 to the rest of the system, and can reduce or eliminate stresses on any joints associated with coil 21. Left brace 23 and right brace 24 can be made of a low thermal conductivity material (e.g. austenitic stainless steel would be preferable to aluminum) to reduce thermal conductivity between non-adjacent segments of coil 21. The braces can also be e.g. plastic or fiberglass, or have thermally insulating attachments to coil 21, such as rubber or plastic grommets.

Figure 3:
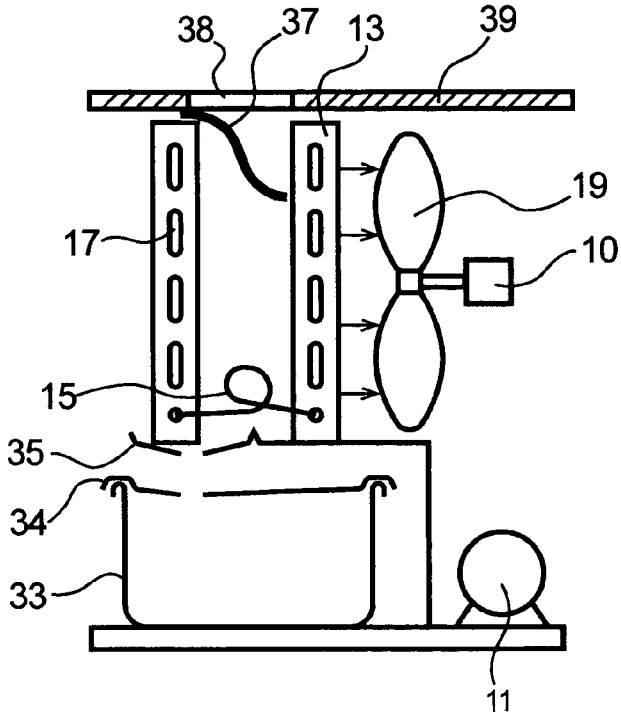
FIG. 3 illustrates an embodiment of the present invention having a bypass opening 38 into the chamber, and a fixed divider plate 37 that determines the fraction of the condenser 13 allocated to dehumidified air.

FIG. 3 illustrates one embodiment of the present disclosure. This embodiment includes a compression-based refrigeration cycle, two converging air flow paths, and a condensate repository. The compression-based refrigeration cycle includes a compressor 11, a condenser 13, an expansion valve 15, and an evaporator 17. A bypass opening 38 through a housing 39 can allow a first air flow to enter housing 39, then a divider plate 37 directs this first air flow to the inlet section of condenser 13; a second air flow can enter through a side filter (not shown) and pass through evaporator 17, and can then be drawn to the remainder of condenser 13; both the first air flow and the second air flow can be pulled through condenser 13 by a fan 19 driven by the fan motor 10. The combined air flow can then exit by passing across fan motor 10.

Bypass opening 38 can allow a first air flow to enter without being cooled by evaporator 17; this first air flow can be referred to as the bypass air flow. Divider plate 37 keeps this bypass air flow from substantially intermixing with or substantially transferring heat to the second air flow entering through evaporator 17; this second air flow can be referred to as the main air flow.

In one embodiment, the part of evaporator 17 closest to divider plate 37 can be the evaporator outlet section, so that air coming through the evaporator outlet section can be directed to that section of condenser 13 containing refrigerant that has just been cooled by the first air flow entering through bypass opening 38. Air coming to the condenser outlet section can come from the remainder of evaporator 17.

Moisture in the main air flow condenses on the evaporator and drips down to a catch tray 35, which directs the condensate to a catch basin 33 below, which has a cover 34 to reduce subsequent evaporation of the condensate. Unless equipped with a drain, overflow of the condensate from catch basin 33 is prevented by detecting when catch basin 33 fills up, e.g. when the weight or level of condensate exceeds a limit value.

The embodiment in FIG. 3 shows a divider plate 37 allocating about ¼ of condenser 13 to the bypass air flow. Between ⅙ and ½ of condenser 13 can typically be allocated to the to the bypass air flow, depending upon ambient conditions. Allocating as little as 1/10 of condenser 13 to the bypass airflow is beneficial under most conditions; when there is little condensate to be removed, a divider plate 37 allocating 7/10 or even 8/10 of the condenser to bypass air is more effective than a conventional system. An adjustable divider plate can be used to change the fraction of the condenser exposed to the bypass air, e.g. by moving the right edge of divider plate 37 along without necessarily contacting the left edge of condenser 13 as the left side of divider plate 37 moves roughly horizontally, adjacent the top of evaporator 17. An embodiment with this type of articulation can have pins on the divider plate 37 moving within slots adjacent the condenser 13 and evaporator 17; this motion can also be approximated by pivots roughly in the plane of evaporator 17, or by a set of linkages. Adjustment can be done manually, or by an automatic control system using an actuator.

Figure 4:
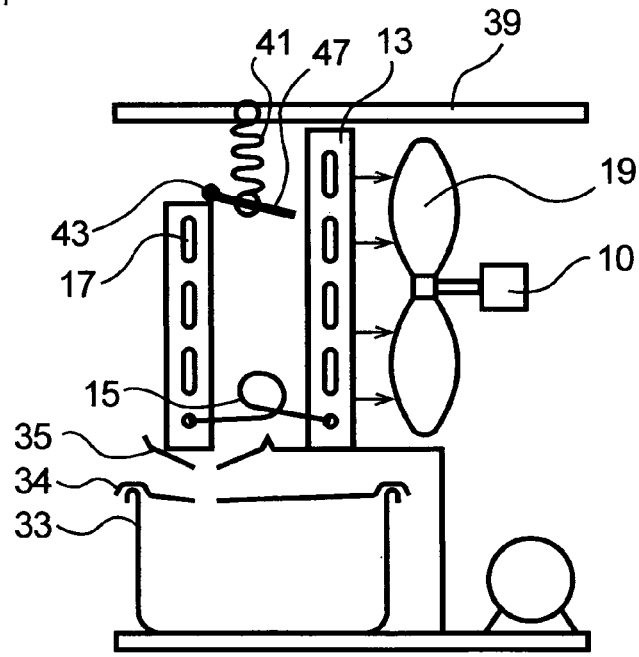
FIG. 4 shows an embodiment with an articulated divider plate 47 and a bypass opening above the evaporator 17.

FIG. 4 shows an embodiment in which the bypass opening is the vertical gap between evaporator 17 and housing 39. An articulated divider plate 47 rotates about a pivot 43. Articulated divider plate 47 keeps the flow of air from the bypass opening separate from the flow of air coming from evaporator 17 without predetermining the fraction of condenser 13 exposed to the bypass air. Instead of predetermining, articulated divider plate 47 can accommodate variations of bypass air flow rates, by rotating about the pivot 43. A preload spring 41 counteracts the weight of articulated divider plate 47; a balancing counter-weight (not shown) can be used instead of or in addition to preload spring 41. A deadening device, e.g. a small shock absorber (not shown), can be included if the dynamics of the particular embodiment would otherwise cause articulated divider plate 47 to flutter during operation. Articulated divider plate 47 allows the fraction of condenser 13 exposed to the bypass air to depend on the flow rate of the air coming through evaporator 17 and the flow rate of air through condenser 13. This ratio can be adjustable, e.g. by restricting the bypass air flow path or the main air flow, such as with a damper or adjustable louvers. Such restrictions can be manually adjustable or actuated by an automatic control system. Articulated divider plate 47 can also be used in conjunction with a bypass opening through the top of the housing. Another type of articulation can be for a divider plate's right edge to move roughly vertically adjacent condenser 13 as the divider plate's left side moves roughly horizontally adjacent the top of evaporator 17.

Figure 5:
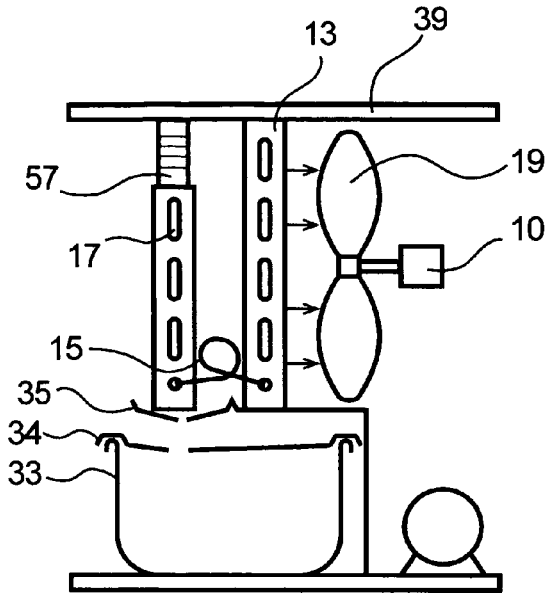
FIG. 5 shows an embodiment with a diffuser 57 across the bypass opening that allows the bypass air flow to converge with the main air flow without substantially intermixing.

FIG. 5 shows an embodiment with a diffuser 57 that can reduce intermixing of the converging air flows from the bypass opening and from evaporator 17. Incoming bypass air flow can span both the width of the chamber and the gap between the top of evaporator 17 and housing 39. The diffuser 57 slows the velocity of air entering through the bypass opening. The velocity along the bottom of the bypass air flow can roughly match the velocity of the air being pulled through the top of evaporator 17, to reduce shear at the interface between the converging flows. The air flow from diffuser 57 and from the top of evaporator 17 can be roughly parallel.

Such an embodiment can also have another baffle acting as a restriction member upstream of the diffuser that allows the velocity of the bypass air flow to be engineered to match these constraints; such a restriction member can be a grille. The fraction of bypass air can then be determined by the combined restriction of the diffuser and the restriction member. If this restriction member is used merely to control the amount of bypass air flow, it can be placed well upstream of the diffuser. In embodiments where a restriction member is intended to create a non-uniform velocity profile, e.g. with maximum velocity along the bottom adjacent the evaporator, reduced velocity along the chamber ceiling, and a roughly uniform gradient, then the restriction member can be adjacent or against the diffuser, or can even dispense with a separate diffuser entirely.

Figure 7A:
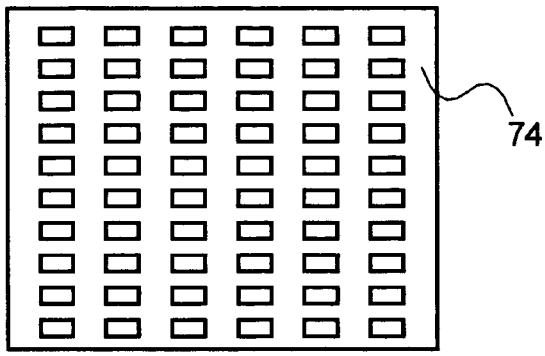
FIG. 7A to 7F show a pair of plates that act as a variable restriction member by moving one relative to the other.
Figure 7B:
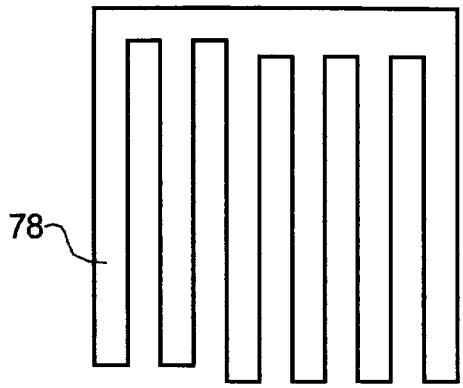
Figure 7C:
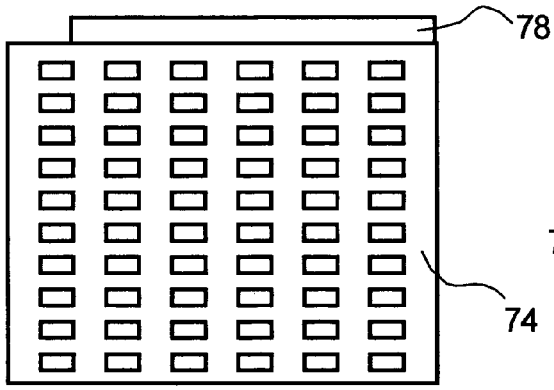
Figure 7D:
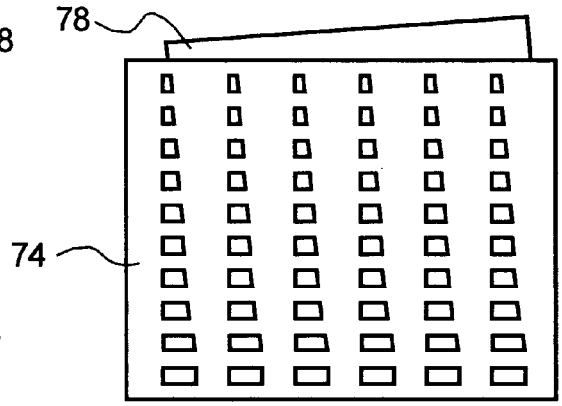
Figure 7E:
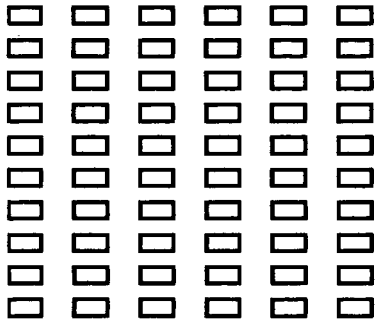
Figure 7F:
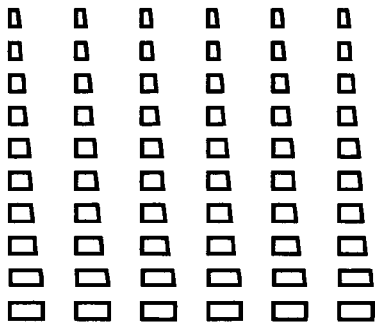

In certain embodiments the restriction member can be adjustable, e.g. by using a pair of plates with corresponding arrays of openings. This preferably allows the velocities of the air flows through the adjacent edges of the restriction and the heat exchanger to continue to roughly match, even while the aggregate air flow through the restriction is adjusted. It can be manually adjustable, or actuated by an automatic control system. Bypass flow can be maximized when the plates were aligned and pressed together, and reduced by moving one plate relative to the other; this motion could be in plane or out of plane. Depending upon the design, the most restrictive setting could eliminate the bypass air flow entirely, or reduce it to a predetermined minimum. For example, FIG. 7A shows a first restriction plate 74 with an array of openings; FIG. 7B shows a second restriction plate 78 with a complementary series of slits. FIG. 7C shows a combination of these plates aligned, allowing maximum flow; the resulting net air passages are shown in FIG. 7E. FIG. 7D shows these plates with a small relative rotation about a point near the center of their bottom edges: this rotation constricts the openings to the air passages shown in FIG. 7F, thereby reducing the air flow. The amount of restriction near the edge of the adjustable restriction that is adjacent a heat exchanger remains roughly constant even though the total restriction varies. Other embodiments with other sets of corresponding shapes include using a pair of plates similar to the one shown in FIG. 7B, the second being the mirror image of the first; rotating one plate with respect to the other about a common point near the center of their bottom edges transforms a series of rectangular air passages into a series of triangular air passages.

Figure 6A:
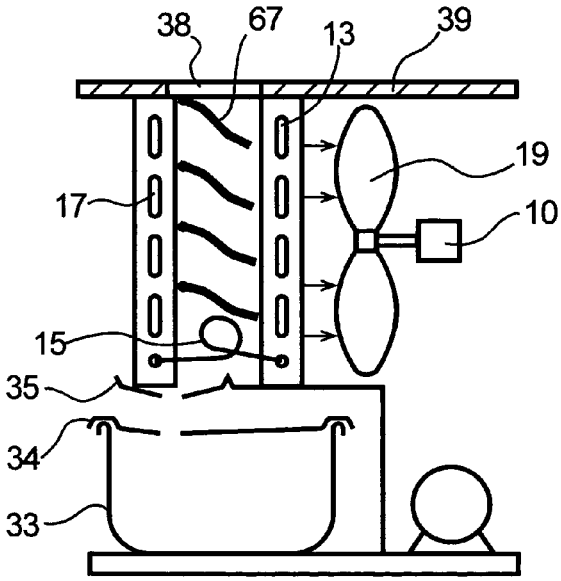
FIG. 6A shows an embodiment with louvers 67 that can allow the bypass air flow and main air flow to converge without substantially intermixing.
Figure 6B:
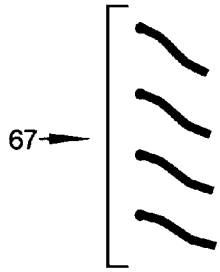
FIG. 6B shows the louvers by themselves.

FIG. 6A shows a set of louvers 67 that direct the converging air flows from the bypass opening 38 and from the evaporator 17 along locally parallel paths to prevent substantial intermixing of these converging flows; louvers 67 are shown isolated in FIG. 6B. One or more of louvers 67 can articulate by manual adjustment, or by an actuator and automatic control system. Louvers 67 not only direct air from bypass opening 38 to the inlet section of condenser 13, they can direct the air from the outlet section of evaporator 17 to the section of condenser 13 through which refrigerant flows immediately after leaving that section of the condenser cooled by air from bypass opening 38. The presence of louvers 67 can also reduce radiant heat transfer from condenser 13 to evaporator 17.

One way for louvers 67 to articulate can be for some or all to pivot about points at or near their leading edges. The lowest louver can move over the smallest angle or not at all, the top louver can move over the largest angle, and each intermediate louver can move more than the louver below it but less than the louver above it. This can be accomplished by appropriate linkages or by connecting them by a series of springs. If done by springs, there can be one tension spring between the trailing edge of the lowest louver and the bottom of the air flow channel, and a tension spring between the trailing edges of each of the consecutive louvers. In one embodiment, all the springs can have about the same compliance, so raising the trailing edge of the top louver causes each louver below to rise by an amount proportional to that louver's location within the vertical stack.

Figure 8A:
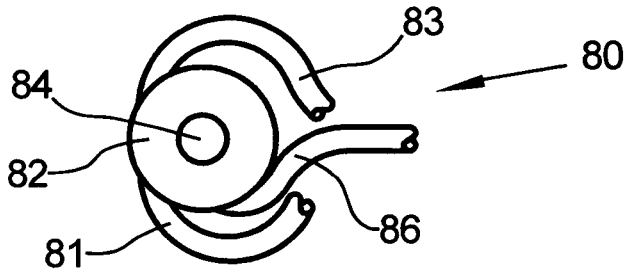
FIGS. 8A and 8B show an embodiment where refrigerant vapor bypasses the last segment of the evaporator.
Figure 8B:
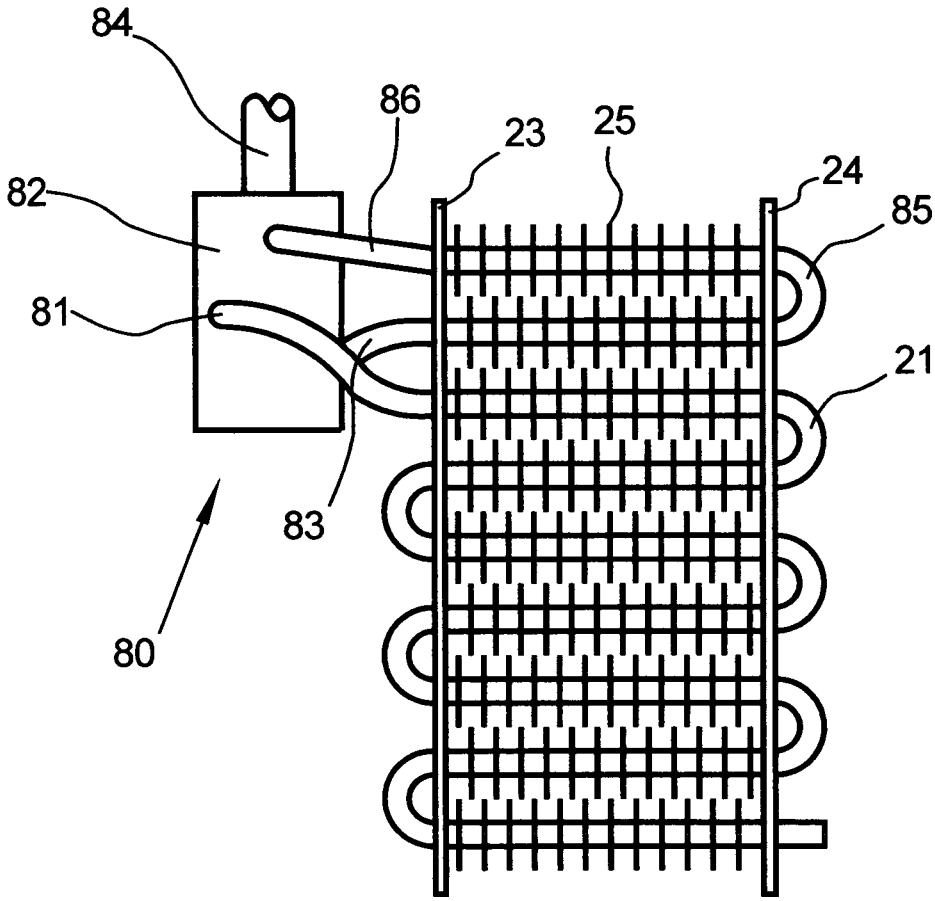

FIG. 8B shows an alternate embodiment of evaporator that reduces heat transfer from the main air flow to vapor phase refrigerant in the evaporator. This embodiment contains a refrigerant vapor separator 80, near the refrigerant outlet section of the evaporator, that uses centrifugal or cyclone separation; a top view of refrigerant separator 80 is shown in FIG. 8A. A mixture of refrigerant vapor and liquid from coil 21 passes through an entrance 81 into a body 82 of the refrigerant vapor separator 80. The vapor fraction of the refrigerant mixture preferentially flows up through a vapor exit 84, and the liquid fraction of the mixture, if any, preferentially flows out near the bottom of the body 82 of the refrigerant vapor separator 80 through a liquid exit 83, then flows through a last section 85 of the evaporator, and returns through a reentry port 86 near the top of body 82 of refrigerant separator 80. Various methods of separating flows containing mixtures of vapor and liquid, such as centrifugal or cyclone separators, are well known in the art; selecting a particular embodiment depends upon several factors, such as the flow velocity and viscosity. Selectively directing vapor phase refrigerant to bypass the last section of the evaporator, the refrigerant outlet section, decreases superheating of the refrigerant vapor leaving the evaporator, thus increasing the efficiency of the refrigeration cycle.

Another embodiment places a separator above the last section of the evaporator, and uses a float valve in the separator to selectively direct liquid refrigerant to flow down to the last section of the evaporator, while selectively directing vapor refrigerant to bypass the last section of the evaporator. Other embodiments are possible, including a variable-length refrigerant outlet section, e.g. by allowing the refrigerant vapor to bypass one section or more than one section; depending upon the embodiment, more than one method could be used. In one embodiment, a cyclone separator can selectively direct liquid refrigerant to the penultimate evaporator section, and a float valve can selectively direct any remaining liquid refrigerant from the penultimate section to the last evaporator section. The refrigerant vapor coming out of the cyclone separator can go to the float valve separator, or bypass the float valve separator and be drawn towards the compressor.

During conditions of high temperature and large condensate load, the refrigerant may become entirely vapor before reaching the last section of the evaporator. In this case, the refrigerant flow essentially bypasses the last section of the evaporator, reducing superheating of the refrigerant vapor. The air flow through the evaporator shown in FIG. 8 can be directed between the left brace 23 and the right brace 24, avoiding thermal contact with vapor separator 80 or tee 86.

Figure 9:
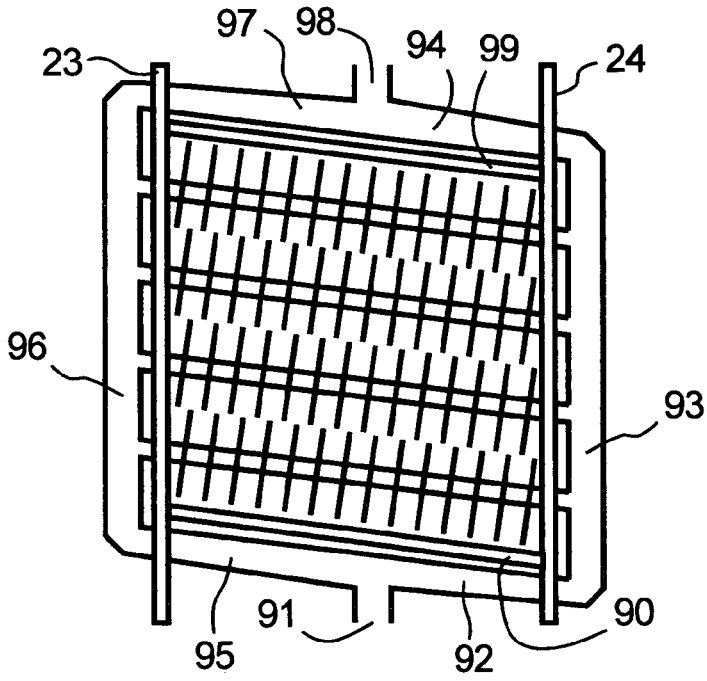
FIG. 9 shows an embodiment where refrigerant vapor bypasses the last one or more segments of the evaporator.

FIG. 9 shows another embodiment of evaporator that reduces heat transfer from the main air flow to vapor phase refrigerant in the evaporator. A flow of refrigerant enters the evaporator through entry port 91. Vapor refrigerant, if any, tends to ascend through tube 95, then enter and rise up through tube 96 and into tube 97; liquid refrigerant tends to descend through tube 92, and then rise into tube 93. Any vapor refrigerant entering or forming within tube 93 tends to rise up until it enters tube 94; liquid refrigerant within tube 93 tends to flow across towards tube 96 through at least one of the finned heat-exchange segments. Vapor refrigerant entering tube 96 from a heat exchange segment tends to rise until it enters tube 97; liquid refrigerant entering tube 96 tends to fall and flow back towards tube 93, through tubes 95 and 92; some liquid refrigerant flowing into tube 96 from one heat exchange segment may flow back towards tube 93 through another heat exchange segment. Vapor refrigerant from tube 97 and tube 94 flows out of the evaporator through exit port 98. Liquid refrigerant that somehow manages to rise out of tube 96 into tube 97 tends to flow across into tube 94 and down into tube 93, rather than rise up through exit port 98.

A left brace 23 and right brace 24 can provide mechanical support for the evaporator shown in FIG. 9; these braces can also provide lateral bounds for the air flowing through the evaporator, reducing heat transfer from tube 96 and tube 93 respectively. A bottom plate 90 can provide a lower bound for the air flow, reducing heat transfer to entry port 91, tube 92 and tube 95; a top plate 99 can provide an upper bound for the air flow, reducing heat transfer to tube 94, tube 97, and exit port 98.

The illustrated embodiment incorporates some redundancy to increase its robustness. Not all tubes shown in this particular embodiment are necessary for every embodiment. For example, if the refrigerant flow through tube 92 into tube 93 is entirely or almost entirely liquid, and tube 93 is well enough insulated so that little or no refrigerant vapor forms within tube 93, then there should be little or no refrigerant vapor within tube 93 and no need for a tube 94 to allow vapor refrigerant to flow from tube 93 to exit port 98: incidental amounts of refrigerant vapor within tube 93 can simply pass through one of the heat exchange segments. If tube 94 is dispensed with, then tube 97 need not exist, and exit port 98 can be at the top of tube 96.

Entry port 91 can be closer to tube 93 or to tube 96. If entry port 91 is adjacent tube 93, then tube 92 can be eliminated and tube 95 can connect tube 96 directly to tube 93; if entry port 91 is adjacent tube 96, then tube 95 can be eliminated and tube 92 can connect tube 96 directly to tube 93.

Insulating tube 92, tube 93, tube 94, tube 95, tube 96, and tube 97 improves the efficiency of the system. Care should be taken in the choice of insulating materials and geometrical design, to avoid damage or impairment due to incidental condensation. For example, a plastic shroud can create a dead air space around a tube; if this dead air space is open at or near the bottom, it can insulate the tube and still allow any incidental condensation on the tube to drain, e.g. into a condensate repository.

The incoming refrigerant can be kept entirely or almost entirely liquid, e.g. by cooling the refrigerant before or as it passes through expansion valve 15, such as by structuring expansion valve 15 as a narrow tube in thermal contact with a segment of tube between tube 93 and tube 96, thus forming expansion valve 15 into part of a counter-flow heat-exchanger. This can allow the refrigerant to enter tube 93 directly from entry port 91, avoiding the need for tube 92. In some embodiments of this type it can be possible to eliminate tube 95 as well.

In the embodiment shown in FIG. 9, the evaporator refrigerant inlet section begins at the right end of the lowest heat exchange segment. The evaporator refrigerant outlet section ends at the left end of the highest heat exchange segment. In embodiments with numerous heat exchange segments, the refrigerant outlet section is not necessarily limited to a single heat exchange segment. The effective length of the evaporator refrigerant outlet section can vary as a function of ambient conditions; for example, high humidity can cause heat to be absorbed by each heat exchange segment more rapidly, decreasing the total number of heat exchange segments needed to vaporize the refrigerant entering the evaporator, thereby increasing the total number of heat exchange segments around which vapor refrigerant is selectively directed.

Superheating of the refrigerant vapor can also be reduced by restricting the air flow through the refrigerant outlet section of the evaporator when this section contains entirely refrigerant vapor. The transition point along the refrigerant flow path between the two-phase refrigerant mixture, which absorbs heat by vaporizing at an essentially constant temperature, and an entirely vapor phase refrigerant, which absorbs heat by warming up, can be determined using temperature sensors at various points along the refrigerant flow path; unfinned bends between the straight finned heat exchange segments, such as those shown in FIG. 2B, can be good places to locate these temperature sensors. By restricting air flow to some or all of the evaporator refrigerant outlet section, refrigerant superheating is reduced and thermodynamic efficiency is improved. This can be done with a damper that treats the entire refrigerant outlet section as a single entity; reducing superheating can also be achieved by restricting air flow by moving a plate or rotating louvers starting from the refrigerant exit point of the evaporator and extending the area of restriction towards the medial section of the evaporator.

Since the effectiveness at a particular adjustment may be determined for any particular set of conditions by measuring the condensation per unit time, it is within the abilities of one skilled in the art to empirically determine the optimal adjustments for a particular embodiment. With an embodiment used as a dehumidifier, the adjustments can be functions of room temperature and relative humidity. Depending upon the particular embodiment, various factors can be adjusted to optimize performance, such as the fraction of the condenser allocated to the bypass air flow, the rate of air flow through the evaporator, or the rate of air flow through the condenser; they can be adjusted either singly or in combination.

The total amount of air flowing through the condenser may be altered by controlling the fan that pulls air through the system, or by adjusting restrictions in the bypass air flow or in the main air flow. When the ambient pressure is too low for sufficient air to passively flow through the bypass opening, e.g. with an in-line system, or with the fan placed upstream of the evaporator, the bypass opening (or a duct leading to the bypass opening) can contain a bypass fan; however, unless the bypass air flow and the main air flow remain isolated until they are about to reach the condenser, e.g. by using a divider plate, the turbulence induced by a bypass fan should be reduced or eliminated prior to the bypass air converging with the main air flow, e.g. by a diffuser across the bypass opening.

In general, optimizing performance can be accomplished subject to the constraint that the flow of air through the evaporator does not become blocked or restricted by solidification of condensate on the evaporator. Dehumidifiers embodying the present disclosure enable the flow rate of air over the evaporator and the flow rate of air over the condenser to be adjusted so as to prevent or minimize the solidification of condensate on the evaporator. An automatic control system can thus act to maintain the temperature of the evaporator just above the freezing point of the condensate.

To optimize performance, various factors can be adjusted, either manually or automatically, depending upon the embodiment, e.g. the fraction of the condenser cooled by bypass air, the fraction of the condenser cooled by air from the evaporator refrigerant outlet segment, the ratio of the rates of air flowing through the evaporator to air flowing through the condenser, the aggregate air flow through the system, the fraction of the evaporator allocated to the condenser refrigerant outlet section, or the fraction of the evaporator bypassed by refrigerant vapor. The general intention would typically be to maximize the rate of condensation per unit time. This can be done for many embodiments using an open-loop control system that uses the ambient temperature and humidity to determine the optimal adjustment(s). It is also desirable to prevent or minimize freezing of the condensate onto the evaporator, since the frozen condensate typically has poor thermal conductivity, and may block air flow. For many combinations of embodiment and ambient conditions, maximum effectiveness is achieved when a closed-loop automatic control system keeps the system running near the threshold of condensate freezing.

Impending freezing of condensate onto the evaporator can be detected, e.g. with a temperature sensor on or adjacent the evaporator: when the evaporator temperature falls below 0° C. (32° F.), freezing can be expected. Actual freezing can also be inferred from the values or rates of change of certain characteristics. These characteristics include the temperature of the evaporator, which drops rapidly once freezing starts, and the characteristics of the compressor motor (such as current draw, rotational speed, or voltage drop, where the sensor can be an ammeter, a tachometer, or a voltmeter, respectively), at least one of which can also change rapidly once freezing starts. Using several sensors to measure these characteristics as functions of time while a prototype of a particular embodiment begins to freeze up under a series of different conditions (various combinations of temperature and humidity representative of the expected range of operation) can indicate which characteristic(s) or rate(s) of change generates the clearest and most robust indicator of actual or impending freezing.

Condensate freezing can be prevented or reversed by modifying the air flow through the system to increase the temperature of the evaporator. This can be done several ways, such as by increasing the rate of air flow through the evaporator, by decreasing the rate of air flow through the condenser, or by decreasing the fraction of the condenser cooled by air that had bypassed the evaporator; these modifications can be done either individually or in combination. For example, in an embodiment using an adjustable restriction in conjunction with an articulated divider plate that reacts to variations in bypass air flow rates, decreasing the rate of bypass air flow also decreases the fraction of the condenser allocated to bypass air flow; in an embodiment with an adjustable divider plate, reducing the fraction of the condenser allocated to bypass air flow also tends to reduce the rate of bypass air flow and increase the rate of air flow through the evaporator. Increasing the power to fan 10 increases the rate of air flow through the evaporator, reducing the evaporator's temperature drop; the fraction of the condenser allocated to bypass air can be reduced concurrently. Once actual or impending freezing is no longer indicated, the modification to the air flow through the system can be reduced or reversed. One step-wise adjustment method can be to make the first change equal to half way from the current point to the appropriate end of the range of adjustability, and make each interpolative step half as large as its predecessor. A closed loop control system can thus adjust the air flow through the system in response to actual or impending freezing of condensate onto the evaporator to operate the system near the threshold of freezing.

A bypass fan can enable an automatic control system to operate at cooler incoming air temperatures without the condensate freezing on the evaporator by decreasing the rate of air flowing in through the bypass opening after detecting actual or impending freezing of condensate on the evaporator. To allow the apparatus to operate without condensate freezing on the evaporator under unusually cold conditions, the bypass fan can actually be reversed, pulling air out of the bypass opening rather than letting undehumidified air in, so that the rate of air flow through the evaporator is actually higher than the rate of air flow through the condenser.

In certain circumstances it may be desirable or necessary to prevent substantial intermixing even after the condenser, in which case a synchronized mirror image of the divider plate can maintain separation of the air passing through the evaporator and the air not passing through the evaporator, even after both air streams have passed through the condenser. This can be accomplished by adding subsequent ducting after the condenser, with a separate fan. The condenser itself can be divided into two sections if no adjustability of the transition point is necessary.

In some of the disclosed embodiments, the transition point (along the refrigerant flow path through the condenser) between the bypass air and the main air flow can be adjusted. For any given embodiment, the best transition point depends upon the ambient conditions. In a dehumidifier configured according to the embodiment shown in FIG. 3, allocating the first 3/10 of the condenser to bypass air worked well over a broad range of temperature and humidity. The optimal transition point depends in part upon the geometry of the particular embodiment as well as the temperature and relative humidity of the incoming air, and may vary from 1/10 to 1/2 of the condenser for typical embodiments over the range of typical indoor conditions; the variation may be even more for unusual embodiments or conditions. For a typical embodiment, allocating 15% of the condenser to bypass air can be effective under low temperature, high humidity conditions, while a 20% allocation can be more effective at room temperature with high humidity; a 25% allocation can work well over a broad range of typical indoor conditions, while a 30% allocation works better as the room becomes drier; a 40% allocation is effective when trying to keep air dry, while a 50% allocation would be appropriate when trying to extract the maximum amount of condensate per volume of air coming through the evaporator, rather than trying to extract the maximum amount of condensate per unit time. Even a 5% to 10% allocation can provide some improvement for most conditions.

Precise optimization of the allocation of the condenser between the bypass air flow and main air flow from the evaporator is not required to benefit from the present invention. While automatic adjustment of the transition point to current conditions can be justified for large commercial units, manual adjustment of the transition point can be adequate for smaller and/or low utilization rate units. When used as a dehumidifier, where the fraction of the condenser exposed to bypass air was randomly varied over the range of 1/5 to 1/3, an embodiment of the present disclosure outperformed an otherwise identical dehumidifier at every tested combination of temperature and humidity, spanning typical comfortable indoor conditions of 21 to 24° C. (70 to 75° F.), from 34 to 54% relative humidity. An embodiment allocating the first 3/10 of the condenser to bypass air increased the effectiveness by about 40 to 50% for moderate humidity levels (around 50% relative humidity) at room temperature. At 24° C. (75° F.) and 43% relative humidity, a small conventional dehumidifier removed 2.5 liters/day, vs. 4.4 liters/day for the same dehumidifier modified with an embodiment of the present disclosure. The drier the air, the greater the advantage: the same embodiment more than tripled the effectiveness of the dehumidifier at 40% relative humidity, from 0.65 liters/day to 2.2 liters/day. These results were achieved with no changes to any of the power-intensive components, i.e., the compressor, compressor motor, fan, or fan motor.

Other embodiments of the present disclosure are possible. For example, U.S. Pat. No. 5,117,651 discloses a conical evaporator below a spiral condenser; the air flows through the system vertically. The condenser is shown winding from the perimeter in towards the center, then back out to the perimeter; its refrigerant inlet section is thus adjacent and thermally coupled to the refrigerant outlet section, in contrast to the present invention. The basic geometry of the cylindrical chamber and vertical air flow could be altered to embody the present invention by changing the refrigerant flow path of the condenser and evaporator coils, and adding a bypass opening. Such a condenser can be wound by starting from the center and spiraling outwards, with the refrigerant inlet section at the center, thermally isolated from a refrigerant outlet at the perimeter. An evaporator can also be made by winding it in a single conical spiral but leaving a hole through the center, allowing a bypass opening; the refrigerant outlet would be at the center. A round vertical duct passing through the hole in the center of the evaporator towards the refrigerant outlet section of the condenser could thus approach some of the advantages of the divider plate described earlier.

While the present teachings are described in conjunction with various embodiments, it is not intended that the present teaching be limited to such embodiments. On the contrary, the present teachings encompass various combinations, alternatives, modifications, and equivalents, as will be appreciated by those of skill in the art. For example, an embodiment allowing the fraction of the condenser cooled by air that had bypassed the evaporator to be varied by using an adjustable divider plate can also allow the ratio of the flow rate of air through the evaporator to the flow rate of air through the condenser to be varied using a bypass fan. In an embodiment controlling ratio of the rate of air flow through the condenser to the rate of air flow through the evaporator to avoid freezing condensate onto the evaporator, the air flow from the evaporator refrigerant outlet section can be preferentially directed to the condenser medial section, independent of whether the vapor phase of the refrigerant preferentially bypasses the evaporator refrigerant outlet section.

The invention claimed is:

1. An apparatus comprising a compression-based refrigeration cycle having a compressor, a condenser, an expansion valve, an evaporator, and a refrigerant; wherein the improvement comprises:

a condenser refrigerant inlet section that is thermally distinct;

a baffle capable of selectively directing air that has bypassed the evaporator to the condenser refrigerant inlet section and selectively directing air from the evaporator to other parts of the condenser;

a condenser medial section that is thermally distinct, an evaporator refrigerant outlet section that is thermally distinct, and a baffle capable of selectively directing air from the evaporator refrigerant outlet section to the condenser medial section.

2. An apparatus comprising:

a compression-based refrigeration cycle having a compressor, a condenser, an expansion valve, and an evaporator; and a vapor phase refrigerant bypass path disposed to allow refrigerant vapor formed within the evaporator to selectively separate from the cycle and bypass a subsequent portion within the evaporator before the refrigerant vapor rejoins the cycle.

3. The apparatus according to claim 2, further comprising:

a condenser refrigerant inlet section that is thermally distinct;

an evaporator refrigerant outlet section that is thermally distinct; and a baffle capable of selectively directing air from the evaporator refrigerant outlet section to the condenser refrigerant inlet section.

4. The apparatus according to claim 2, further comprising:

a condenser refrigerant inlet section that is thermally distinct;

a condenser medial section that is thermally distinct;

an evaporator refrigerant outlet section that is thermally distinct; and a baffle capable of selectively directing air that has bypassed the evaporator to the condenser refrigerant inlet section and selectively directing air from the evaporator refrigerant outlet section to the condenser medial section.

5. An apparatus comprising:

a compression-based refrigeration cycle comprising a compressor, a condenser, an expansion valve, and an evaporator;

a sensor capable of detecting impending or actual freezing of a condensate on the evaporator; and a control system adapted to automatically adjust air flow through the apparatus in response to detection of impending or actual freezing of condensate on the evaporator by the sensor, whereby freezing of condensate on the evaporator is prevented or reversed.

6. The apparatus according to claim 5, further comprising a vapor phase refrigerant bypass path disposed to allow refrigerant vapor formed within the evaporator to selectively separate from the cycle and bypass a subsequent portion of the evaporator before the refrigerant vapor rejoins the cycle.

7. The apparatus according to claim 5, further comprising:

a condenser refrigerant inlet section that is thermally distinct; and a baffle capable of selectively directing air that has bypassed the evaporator to the condenser refrigerant inlet section and selectively directing air from the evaporator to other parts of the condenser.

8. The apparatus according to claim 7, further comprising:

a condenser medial section that is thermally distinct;

an evaporator refrigerant outlet section that is thermally distinct; and a baffle capable of selectively directing air from the evaporator refrigerant outlet section to the condenser medial section.

9. The apparatus according to claim 8, further comprising:

a vapor phase refrigerant bypass path around the evaporator refrigerant outlet section.

10. A method of operating an apparatus comprising a compression-based refrigeration cycle having a compressor, a condenser with a condenser refrigerant inlet section that is thermally distinct, an expansion valve, an evaporator, and a refrigerant, wherein the apparatus further comprises a condenser medial section and an evaporator refrigerant outlet section that are thermally distinct; the method comprising:

selectively directing air that has bypassed the evaporator to the condenser refrigerant inlet section;

selectively directing air from the evaporator to other parts of the condenser; and selectively directing air from the evaporator refrigerant outlet section to the condenser medial section.

11. A method of operating an apparatus comprising a compression-based refrigeration cycle having a compressor, a condenser, an expansion valve, an evaporator, and a refrigerant capable of absorbing heat as the refrigerant transitions from a liquid phase to a vapor phase, the method comprising:

selectively directing vapor phase refrigerant in the evaporator to separate from the cycle and bypass a subsequent portion of the evaporator, while selectively directing liquid phase refrigerant in the evaporator through the subsequent portion of the evaporator.

12. The method according to claim 11, wherein the apparatus further comprises a condenser refrigerant inlet section that is thermally distinct, and an evaporator refrigerant outlet section is thermally distinct, the method further comprising:

selectively directing air from the evaporator refrigerant outlet section to the condenser refrigerant inlet section.

13. The method according to claim 11, wherein the condenser has a condenser refrigerant inlet section and a condenser medial section that are thermally distinct, and an evaporator refrigerant outlet section is thermally distinct, the method further comprising the steps of:

selectively directing air that has bypassed the evaporator to the condenser refrigerant inlet section; and selectively directing air flow from the evaporator refrigerant outlet section to the condenser medial section.

14. A method of operating an apparatus comprising a compression-based refrigeration cycle having an expansion valve, an evaporator, a compressor, a condenser, and a refrigerant capable of absorbing heat as the refrigerant transitions from a liquid phase to a vapor phase, comprising the steps of:

detecting impending or actual freezing of a condensate on the evaporator; and modifying the air flow through the apparatus to prevent or reverse freezing of the condensate on the evaporator.

15. The method according to claim 14, further comprising:

selectively directing vapor phase refrigerant in the evaporator to separate from the cycle and bypass a subsequent portion of the evaporator, while selectively directing liquid phase refrigerant in the evaporator through the subsequent portion of the evaporator.

16. The method according to claim 14, wherein the condenser comprises a condenser refrigerant inlet section that is thermally distinct; the method further comprising:

selectively directing air that has bypassed the evaporator to the condenser refrigerant inlet section, and selectively directing air from the evaporator to other parts of the condenser.

17. The method according to claim 16, wherein the evaporator comprises an evaporator refrigerant outlet section that is thermally distinct and the condenser comprises a condenser medial section that is thermally distinct; the method further comprising:

selectively directing air from the evaporator refrigerant outlet section to the condenser medial section.

18. The method according to claim 17, further comprising:

selectively directing vapor phase refrigerant in the evaporator around the evaporator refrigerant outlet section, and selectively directing liquid phase refrigerant in the evaporator through the evaporator refrigerant outlet section.

19. A method for operating an apparatus comprising a compression-based refrigeration cycle having a compressor, a condenser, an expansion valve, an evaporator, and a refrigerant capable of absorbing heat as it transitions from a liquid phase to a vapor phase, comprising the steps of:

detecting an increase in superheating of the vapor phase in the evaporator; and reducing airflow through at least a portion of the evaporator in response to the increase in superheating, whereby superheating of the vapor phase of the refrigerant is reduced.

20. The method of claim 19, the apparatus further comprising an evaporator refrigerant outlet section that is thermally distinct, wherein the step of reducing the airflow through at least a portion of the evaporator comprises reducing airflow through the evaporator refrigerant outlet section.

21. The apparatus of claim 5, wherein a fraction of the condenser is cooled by air that has bypassed the evaporator, and wherein the control system is adapted to respond to detection of impending or actual freezing of condensate on the evaporator by automatically decreasing the fraction of the condenser cooled by air that has bypassed the evaporator.

22. The apparatus of claim 5, wherein a fraction of air flow through the condenser has bypassed the evaporator, and wherein the control system is adapted to respond to detection of impending or actual freezing of condensate on the evaporator by automatically decreasing the fraction of air flow through the condenser that has bypassed the evaporator.

23. The apparatus of claim 5, wherein a ratio of air flow through the condenser to air flow through the evaporator can be varied, and wherein the control system is adapted to respond to detection of impending or actual freezing of condensate on the evaporator by automatically decreasing the ratio of air flow through the condenser relative to air flow through the evaporator.

24. The method of claim 14, wherein a fraction of the condenser is cooled by air that has bypassed the evaporator, and wherein the step of modifying the air flow through the apparatus to prevent or reverse freezing of condensate on the evaporator comprises decreasing the fraction of the condenser cooled by air that has bypassed the evaporator.

25. The method of claim 14, wherein a fraction of air flow through the condenser has bypassed the evaporator, and wherein the step of modifying the air flow through the apparatus to prevent or reverse freezing of condensate on the evaporator comprises automatically decreasing the fraction of air flow through the condenser that has bypassed the evaporator.

26. The method of claim 14, wherein a ratio of air flow through the condenser to air flow through the evaporator can be varied, and wherein the step of modifying the air flow through the apparatus to prevent or reverse freezing of condensate on the evaporator comprises decreasing the ratio of air flow through the condenser relative to air flow through the evaporator.

* * * * *